US007184019B2

(12) United States Patent
Imai et al.

(10) Patent No.: US 7,184,019 B2
(45) Date of Patent: Feb. 27, 2007

(54) BACK LIGHT CONTROL METHOD AND PROGRAMMABLE CONTROLLER HAVING A DISPLAY DEVICE WITH A BACK LIGHT

(75) Inventors: Norihiro Imai, Kyoto (JP); Hiromi Ishihara, Kyoto (JP); Kei Takahashi, Kyoto (JP); Noriaki Suzuki, Kyoto (JP)

(73) Assignee: OMRON Corporation, Kyoto (JP)

( * ) Notice: Subject to any disclaimer, the term of this patent is extended or adjusted under 35 U.S.C. 154(b) by 63 days.

(21) Appl. No.: 10/062,279

(22) Filed: Jan. 30, 2002

(65) Prior Publication Data

US 2002/0122023 A1 Sep. 5, 2002

(51) Int. Cl.
*G09G 3/36* (2006.01)

(52) U.S. Cl. ..... 345/102; 345/87; 345/55; 345/211

(58) Field of Classification Search ..... 345/102, 345/109, 211, 212, 213, 214, 87, 127, 112
See application file for complete search history.

(56) References Cited

U.S. PATENT DOCUMENTS 4,958,915 A * 9/1990 Okada et al. ..... 345/97
5,019,808 A * 5/1991 Prince et al. ..... 345/88
5,589,848 A * 12/1996 Shimizu ..... 345/102
5,933,089 A * 8/1999 Katada ..... 340/7.55
6,219,021 B1 * 4/2001 Izumi ..... 345/102
6,452,582 B1 * 9/2002 Rolston ..... 345/102

FOREIGN PATENT DOCUMENTS

| | | |
|---|---|---|
| JP | 03-168616 | 7/1991 |
| JP | 05-224713 | 9/1993 |
| JP | 05-289707 | 11/1993 |
| JP | 06-075610 | 3/1994 |
| JP | 11-126118 | 5/1999 |
| JP | 2000-242315 | 9/2000 |
| JP | 2000-276248 | 10/2000 |

* cited by examiner

*Primary Examiner*—Richard Hjerpe
*Assistant Examiner*—Leonid Shapiro
(74) *Attorney, Agent, or Firm*—Beyer Weaver LLP

(57) ABSTRACT

A display device such as an LCD having a back light is provided with at least one display setting data group including a message to be displayed and a control command for controlling the switching on and off of the back light. A parameter for selectively specifying a display setting data group is included in the display command. The back light for the LCD is switched on and off, controlled by the control command included in the display setting data group selectively specified by the parameter.

6 Claims, 5 Drawing Sheets

BACK LIGHT CONTROL METHOD AND PROGRAMMABLE CONTROLLER HAVING A DISPLAY DEVICE WITH A BACK LIGHT

This application claims priority on Japanese patent application 2001-023641 filed Jan. 31, 2001.

BACKGROUND OF THE INVENTION

The invention relates to a method of controlling a display device having a back light, as well as to such a display device. In particular, this invention relates to such a method and a device mounted to a programmable controller.

A back light is generally provided to a display device for a PLC or a so-called programmable terminal (PT) for improving the visibility of data and character arrays which are displayed on the display device.

On the other hand, programmable controllers for controlling apparatus of different kinds are being required not only to be usable for a wider variety of purposes but also to be compact. Thus, display devices having a back light are coming to be mounted to a programmable controller. Back lights which are mounted to a conventional programmable controller, however, are controlled to be switched on and off by a system program according to a preliminarily set on/off pattern. As a result, most of the controls were either for leaving it on all the time or for keeping the light on for a specified length t whenever a button is pressed, as shown in FIG. 7.

A back light for a display device is not only for improving the visibility of data and character arrays which are displayed on the display device but also to serve to give a warning to the user. Thus, it is desirable that its on-off control be effected automatically, in the case of a programmable controller, for example, according to conditions of different kinds set by the user for providing a warning. With a back light for a conventional display device, however, such a flexible on-off control suitable to the user's purpose for use could not be effected because its on-off control was uniquely determined by a system program.

SUMMARY OF THE INVENTION

It is therefore an object of this invention to provide a method of controlling a back light of a display device such that it can be switched on and off according to its purpose of use by the user.

It is another object of this invention to provide a display device of which the on-off control of its back light can be effectively carried out according to the purpose of use by the user.

A method of controlling the back light of a display device according to this invention, by which the above and other objects can be accomplished, may be characterized as comprising the steps of providing at least one display setting data group including a message to be displayed on the display device and a control command for switching the back light on and off and specifying a parameter in a display command addressed to the display device, thereby selectively specifying one of the at least one display setting data group such that the back light is switched on and off according to the control command included in the specified display setting data group. Alternatively, the control command may be directly contained in the display command, not through a parameter. The color of the back light may be similarly controlled.

A display device with a back light according to this invention may be provided with at least one display setting data group including a message to be displayed on the display device and a control command for switching the back light on and off. It may be characterized as comprising an extracting means for selectively specifying a display setting data group by a parameter and extracting a control command from the specified display setting data group, and a control means for controlling switching of the back light on and off according to the control command extracted by the extracting means. The parameter is included in a display command addressed to the display device and serves to selectively specify a display setting data group. Instead of providing such an extracting means, the command may be directly included in the display command.

In the above, the display command may be a command for displaying a specified data item or character array in a user program of a programmable controller, and the control command may be for controlling the switching of the back light on and off. The control means may be designed so as to switch on the back light in response to the control command and then switching it off after keeping it on for a specified length of time.

BRIEF DESCRIPTION OF THE DRAWING

The invention, together with further objects and advantages thereof, may best be understood by reference to the following description taken in conjunction with the accompanying drawings in which.

DETAILED DESCRIPTION OF SPECIFIC EMBODIMENTS

Figure 1:
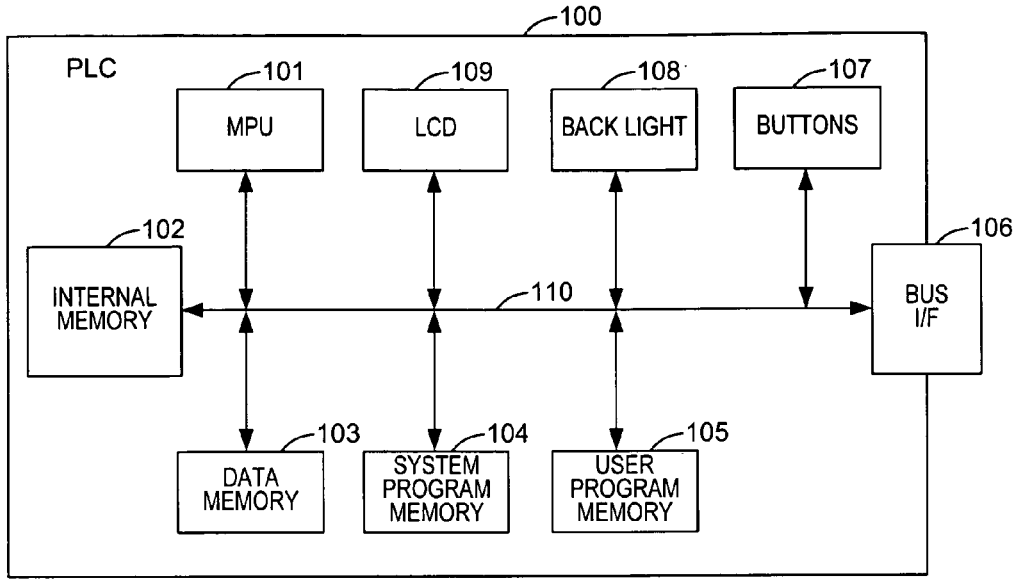
FIG. 1 is a block diagram of a CPU unit of a programmable controller having a display device of this invention mounted thereto.

The invention is described next by way of an example with reference to FIG. 1 which is a block diagram of a CPU unit of a programmable controller (PLC) 100 having mounted thereto a display device embodying this invention and FIG. 2 which is an external view of this CPU unit 100-1.

The CPU unit 100-1 of this programmable controller 100 is comprised of an MPU (micro-processing unit) 101, an internal memory 102, a data memory 103, a system program memory 104, a user program memory 105, a bus interface (I/F) 106, operating buttons 107, a back light 108 and a liquid crystal display (LCD) 109, which are connected to one another by a system bus 110. The MPU 101 is for controlling the entire operations of the programmable controller 100. The internal memory is for storing the internal data of this programmable controller 100, and the data memory 103 is for storing data of various kinds. The system program memory 104 is for storing the system program of this programmable controller 100, and the user program memory 105 is for storing a user program. The bus I/F 106 serves as an interface with the system bus 110. An I/O unit and high efficiency units (not shown) may be connected through this I/F bus 106. What is herein referred to as the operating buttons 107 may include, according to the illustrated example, cursor keys 107*a*, a delete (DEL) key 107*b*, an alternate (ALT) key 107*c*, an escape (ESC) key 107*d* and an execution (OK) key 107*e* which are to be operated by the user.

The LCD 109 is a display device for displaying various data related to the operations of this programmable control. The CPU unit 100-1 of the programmable controller 100 is also provided with input terminals 111*a*, output terminals 111*b* and power terminals 111*c* to serve as input/output and power supply parts.

Figure 3:
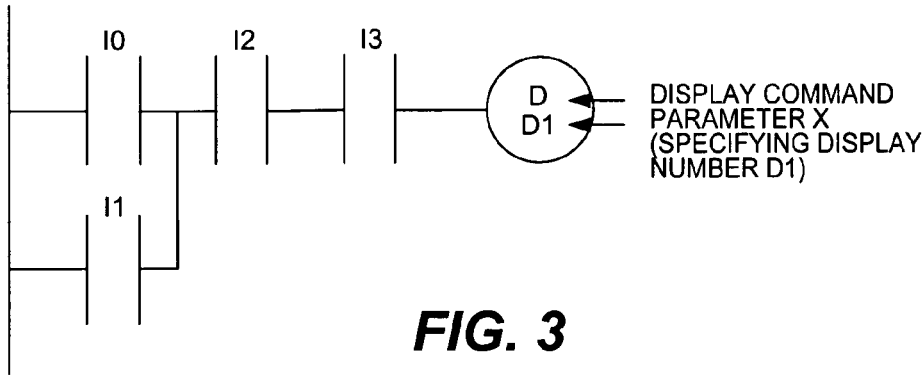
FIG. 3 shows an example of user program (as a ladder diagram) stored in the user program memory of the programmable controller shown in FIG. 1.

With the programmable controller 100 according to this embodiment of the invention, the on-off control of the back light 108 is effected by a display command described in the user program stored in the user program memory 105 such as a diagram including display commands D, as shown in FIG. 3. In FIG. 3, symbols I0–I3 indicate contacts and symbol D indicates a display command for the LCD 109 serving as the display device. The display commands include parameters X such as display numbers D0, D1, D2, . . . If display number D1 is recorded as Parameter X, for example, display setting data group D100 including display number D1 are selectively specified. In other words, Parameter X is used to selectively specify one of a plurality of display setting data groups D000, D100, D200, . . . as shown in FIG. 4.

Figure 4:
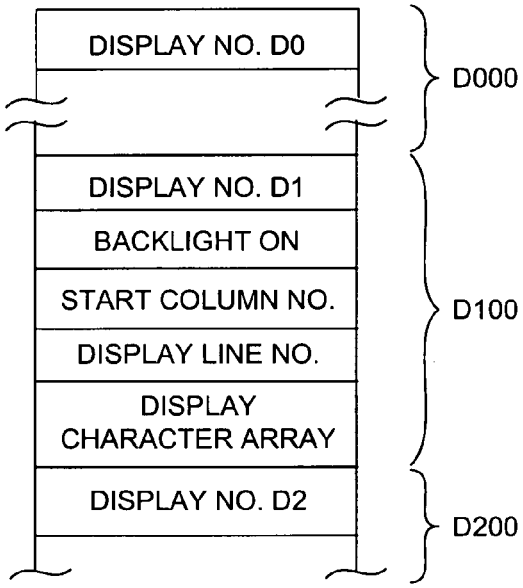
FIG. 4 shows an example of display setting data which may be selectively specified by a parameter in a display command of the user program shown in FIG. 3.
Figure 7:
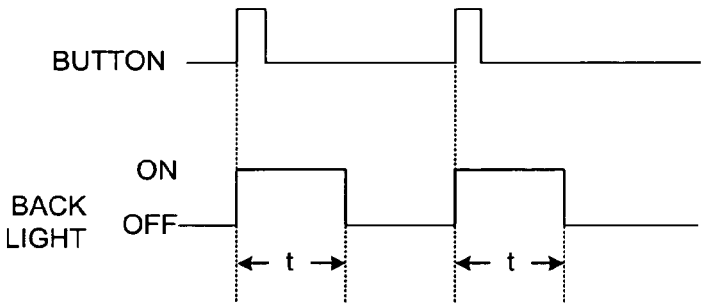
FIG. 7 (PRIOR ART)
FIG. 7 is an example of timing chart for a prior art on-off control of a back light.

FIG. 4 shows an example of contents of the plurality of display setting data groups D000, D100, D200, . . . Display setting data group D100 is for setting display data for the LCD 109 and includes data items such as (1) display number D1; (2) back light switch-on command; (3) display start column number; (4) display line number; and (5) display character array. The other display setting data groups such as D200 may include similar data items.

Of the data items contained in the aforementioned display setting data group D100, data item "D1" (1) indicates that this display setting data group D100 is one of display setting data groups for the LCD 109 and is used when the display data setting group D100 is selectively specified by way of the parameter X contained in the display command D.

Data item "back light switch-on command" (2) is a control specification introduced by the present invention for switching on and off the back light 108. The back light 108 for the LCD 109 is switched on if this specification is present.

Data items "display start column number" (3) and "display line number" (4) are for specifying the display position of a message of various kinds to be displayed on the display screen of the LCD 109. Data item "display character array" (5) is for specifying a character array to be displayed on the display screen of the LCD 109. Since these data items are the same as those that used to be used in prior art display commands, they will not be described further in detail.

In addition to the data items shown above, another data item "back light switch-off command" may be additionally included for controlling the switching of the back light 108 on and off. It will be similar to the back light switch-on command except the back light 108 of the LCD 109 will be switched off when the back light switch-off command is present.

If the back light is designed to emit different colors of light, the selection of color may be carried out through the aforementioned data item "back light switch-on command".

Figure 2:
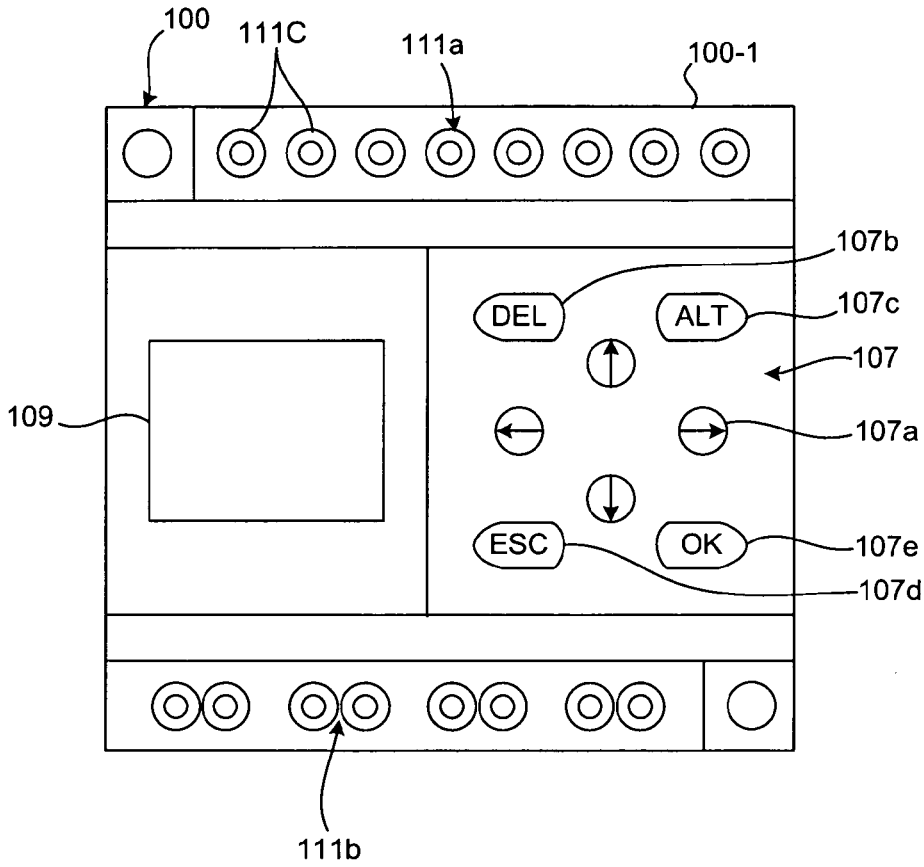
FIG. 2 is an external view of the CPU unit shown in FIG. 1.

An example of process for carrying out a display command in the user program stored in the user program memory 105 of the programmable controller 100 shown in FIG. 1 is explained next with reference to the flowchart of FIG. 5.

When a display command is carried out, if the display command D has "D1" written in its parameter X, the display setting data group D100 which includes data with display number "D1" is selectively specified and a process is carried out for checking whether a "back light switch-on command" is included in the display setting data group D100 as a control command (Step 303). In other words, the means for carrying out the process in Step 303 may be said to function as an extracting means for selectively specifying the display setting data group D100 according to the parameter X (including "D1") written in the display command D of the user program and extracting the "back light switch-on command" as a control command from the display setting data group D100. If the selectively specified display setting data group D100 is found not to include the "back light switch-on command" as a control command (NO in Step 303), the process is immediately ended. If the "back light switch-on command" is found to be included in the selectively specified setting data group D100 (YES in Step 303), on the other hand, the back light 108 of the LCD 109 is caused to be switched on (Step 304).

Next, a timer (not shown) is started for counting a specified time interval t (Step 305). Until this time interval t is counted up by the timer (NO in Step 306), the back light 108 remains switched on. When time t is counted up (YES in Step 306), the back light 108 is switched off (Step 307) and the process is completed.

Figure 5:
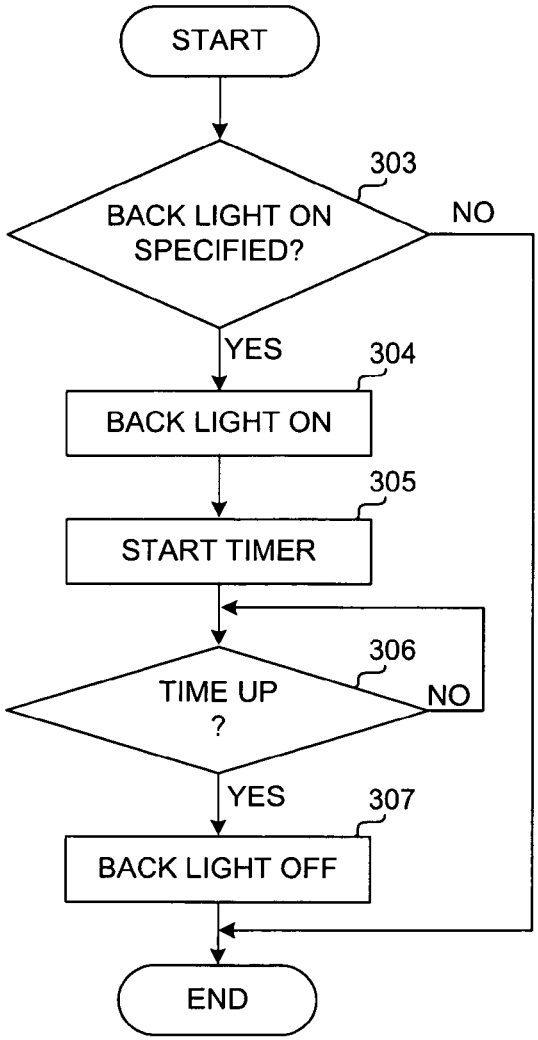
FIG. 5 is a flowchart of an example of process for the on-off control of a back light by the programmable controller shown in FIG. 1.
Figure 6:
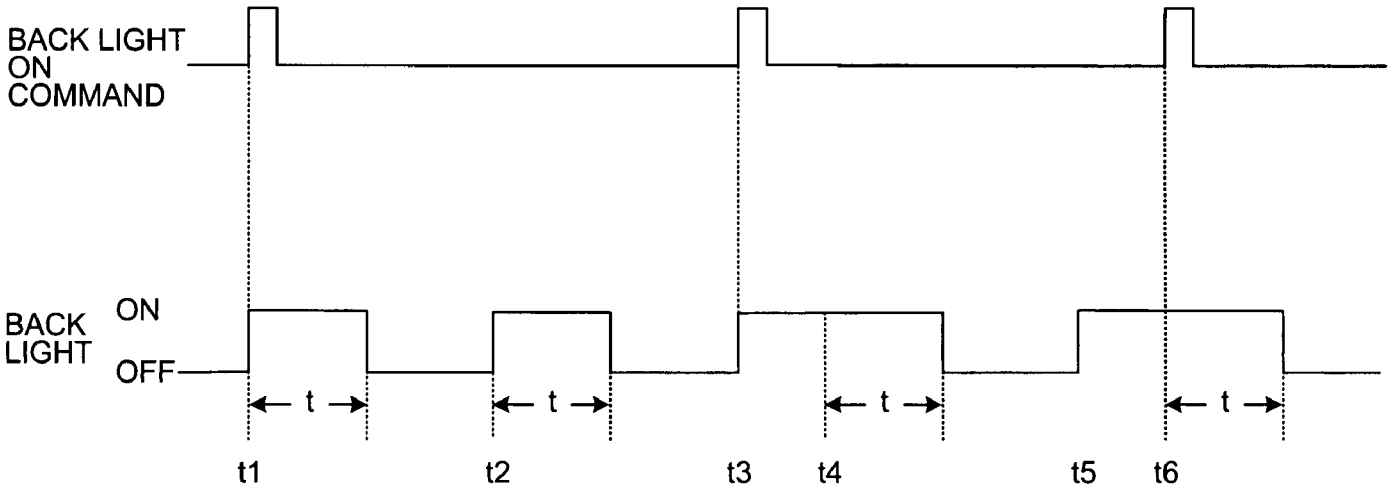
FIG. 6 is a timing chart for the example of the on-off control process shown by the flowchart of FIG. 5.

The example of the back light switch control process shown by the flowchart of FIG. 5 is explained next with reference to the timing chart of FIG. 6. First, a display command D in the user program (the ladder diagram) is carried out at time t1, and the display setting data group D100 is selected by the parameter X (including D1) written in this control command D. As the "back light switch-on command" included in this display setting data group D100 is generated, the back light 108 of the LCD 109 is switched on for a preliminarily set time interval t.

The back light 108 remains switched on again for the same preliminarily set time interval t, starting at time t2. This, however, is not in response to the display command D but is because the user has pushed down the button 107. At time t3 when another display command D is carried out in the user program, the back light 108 is switched on again. If the user subsequently pushes down the button 107 at t4 before time t elapses since the point in time t3, the timer, which was referred to in Step 305 in the flowchart of FIG. 5, is restarted and the back light 108 remains switched on for another time interval t starting at t4.

If the user pushes the button 107 again at time t5, the back light 108 is switched on. At time t6, in less than a time of t after time t5, still another display command D is carried out in the user program, and as the "back light switch-on command" is generated, the timer is restarted as shown in FIG. 5 at Step 305 and the back light 108 remains switched on until time t elapses since time t6.

Although the invention has been described above by way of only one example, this example is not intended to limit the scope of the invention. Many modifications and variations are possible within the scope of the invention. Although the switch-off control of the back light 108 is carried out by the system according to the example shown in FIG. 4, this may be carried out by a display command of the user program. This can be done by including a back light switch-off command as a control command in the display setting data group D100. Such a back light switch-off command may include the time interval from the time at which the back light is switched on until the time at which it is switched off. The operation of switching off may alternatively be carried by way of a command dedicated to the switching off of the back light.

Since the on-off control of the back light 108 is effected according to the example described above not only by the pushing down of the button by the user but also by a display command in the user program, the visibility of the data or the character array displayed on the LCD 109 can be improved by the lighting from the back light 108, and it can also be used to give the user a warning. For such a purpose, it may be arranged so as to change the color of the back light 108 in order to more effectively call the attention of the user to the warning.

Although the display command D according to the example described above included only the parameter X without the contents of the parameter X such as the display setting data group D100, display setting data groups such as D100 may be directly described in the display command D.

Although the invention has been described above as the method of back light control and the displace device as used in connection with an PLC, neither is this intended to limit the scope of the invention. It goes without saying that the present invention may be applicable to any display device such as PT having a back light.

In summary, the present invention is characterized as the on-off control of a back light by a display command to the display device such that the back light can be switched on and off effectively according to the purpose of use by the user. Moreover, since the back light can be switched on and off by commands in the user program, their timing schedule can be prepared or reviewed when the user program is newly created or modified, and the back light can be switched on and off according to a prepared schedule. In particular, the back light can be prevented from being left switched on, and this means that a wasteful energy consumption can be prevented.

What is claimed is:

1. A method of controlling a back light of a display device included in a programmable controller which cyclically executes a user program; said method comprising the steps of:

providing at least one display setting data group including a message to be displayed on said display device, a control command for switching on and off said back light, a display start column number and a display line number indicating display position of said message;

extracting said display start column number and said display line number from the specified display setting data group; and specifying a parameter in a user program of said programmable controller, thereby selectively specifying one of said at least one display setting data group, wherein said back light is switched on and off according to the control command included in the specified display setting data group and wherein said parameter is specified in a display command that is a command to display said message.

2. The method of claim 1 wherein said user program is stored in a user program memory which is different from a system program memory that stores a system program for said programmable controller.

3. The method of claim 1 wherein said control command controls switching on and off of said back light, said control command causing said back light to be switched on and then switched off after a specified time length has elapsed.

4. A programmable controller having a display device having a back light, said display device being provided with at least one display setting data group including a message to be displayed on said display devices, a control command for switching on and off said back light, a display start column number and a display line number indicating display position of said message, said programmable controller comprising:

an extracting means for selectively specifying one of said at least one display setting data group by a parameter and extracting a control command from the specified display setting data group and said display start column number and said display line number from the specified display setting data group, said parameter being included in a user program of said programmable controller addressed to said display device and serving to selectively specifying said specified display setting data group;

a control means for controlling switching on and off of said back light according to said control command extracted by said extracting means;

an execution means that executes said user program cyclically;

a system program memory that stores a system program for said control means; and a user program memory which is different from said system program memory and stores said user program.

5. The programmable controller of claim 4 wherein said parameter is included in a display command that is a command to display said message.

6. The programmable controller of claim 4 wherein said control command controls switching on and off of said back light, said control command causing said back light to be switched on and then switched off after a specified time length has elapsed.

* * * * *

UNITED STATES PATENT AND TRADEMARK OFFICE

CERTIFICATE OF CORRECTION

PATENT NO. : 7,184,019 B2
APPLICATION NO. : 10/062279
DATED : February 27, 2007
INVENTOR(S) : Imai et al.

It is certified that error appears in the above-identified patent and that said Letters Patent is hereby corrected as shown below:

In the Title Page:

Add the following section:

--(30) Foreign Application Priority Data

Jan. 31, 2001 (JP) ..... 2001-023641--

Signed and Sealed this

Thirteenth Day of November, 2007

JON W. DUDAS
*Director of the United States Patent and Trademark Office*